United States Patent [19]

Villavicencio et al.

[11] Patent Number: 4,889,591

[45] Date of Patent: Dec. 26, 1989

[54] *CROTALARIA JUNCEA* PAPER PULPS

[75] Inventors: Eduardo J. Villavicencio, Mexico City, Mexico; Camilo Gomez-Estevez, Calli, Colombia

[73] Assignee: Process Evaluation and Development Corporation, Dallas, Tex.

[21] Appl. No.: 199,804

[22] Filed: May 27, 1988

[51] Int. Cl.[4] ..... D21B 1/14

[52] U.S. Cl. ..... 162/20; 162/90; 162/98; 162/99; 162/148; 162/149

[58] Field of Search ..... 162/19, 98, 90, 99, 162/94, 148, 149, 25, 20; 19/5 R, 10

[56] References Cited

U.S. PATENT DOCUMENTS

| | | | |
|---|---|---|---|
| 3,238,088 | 3/1966 | Villavicencio et al. | 162/19 |
| 3,595,487 | 7/1971 | Bidwell | 162/149 |
| 4,106,979 | 8/1978 | Ruffini et al. | 162/78 |
| 4,347,101 | 8/1982 | Villavicencio | 162/25 |
| 4,689,117 | 8/1987 | Villavicencio | 162/96 |

OTHER PUBLICATIONS

1123 Misra, N.D. Chemical Pulp from Sunn Hemp Stalks; Indian Pulp Paper 18, No. 3: 211–214, (Sep. 1963); AB1PC34:1168.

1124 Misra, N. D. A Continuous Elutriation—Method for Pulping Bagasse Tappi, 46, No. 2: 146–9A, (Feb. 1963); ABIPC 33:1456.

Fiber Crops; James M. Dempsey, Univ. of Florida Press 1975—Chapter 9, Sunn Hemp.

*Primary Examiner*—Peter Chin

*Attorney, Agent, or Firm*—Michael J. McGreal

[57] ABSTRACT

The present process produces a long fiber suitable for making various paper products. The long fiber is derived from *Crotalaria juncea.* The processing consists of a particular technique for preparing the fiber for digestion and a particular digestion sequence. In the preparation of the fiber for digestion it is dried to less than about 30 percent moisture, moist depithed, washed and wet depithed. The fiber is then processed at a high caustic concentration using a sequence of digestion-pressure reduction-digestion. Optionally there can be a third stage of digestion with a pressure reduction prior to the digestion. After digestion has been completed the fiber is refined and sent to blowdown. The fiber is then screened, washed and bleached. The resulting long fiber will product a high quality paper or is admixed with short fibers and various paper products can be made.

20 Claims, No Drawings

*CROTALARIA JUNCEA* PAPER PULPS

This invention relates to a method for making paper pulps from *Crotalaria juncea*. More particularly, this invention relates to a process for producing long-fiber paper pulps using the *Crotalaria juncea* plant as the source of the fiber.

There are some 600 species of the Crotalaria plant. About five of these species are native to North America. *Crotalaria juncea* is not one of the species that is native to North America. However, *Crotalaria Juncea* is known for its long fiber content. Since *Crotalaria Juncea* has long fiber, it has been used in the past as a replacement for hemp to make rope, fishing nets, canvas and various paper products. *Crotalaria Juncea,* as well as several of the other Crotalaria species, can be used as a green manure in order to improve a soil. In this use, the Crotalaria breaks up the soil and keeps the soil from hardening to a form which is difficult to cultivate.

*Crotalaria juncea* is a tropical or subtropical legume type of plant that is also known as Sunn Hemp. As a legume, it fixes nitrogen into the soil rather than requiring nitrogen in order to grow. Consequently, *Crotalaria Juncea* does not require any applications of nitrogenous fertilizer during its growth cycle. In fact, *Crotalaria Juncea* can be used very effectively as a rotation crop in order to build up the nitrogen content of a soil. It can also very effectively be used as a row rotation crop in order to essentially do the same thing, i.e., fix nitrogen into the soil.

Although *Crotalaria juncea* has many agricultural advantages, one prime attribute of this plant is the length of the fibers. The *Crotalaria Juncea* fibers have a length of about 4.5 to 5.0 millimeters. In contrast, soft wood has a fiber length of about 3 to 4 millimeters. That is, *Crotalaria Juncea* has a longer fiber length than soft wood. The diameter of *Crotalaria Juncea* is less than that of soft wood with *Crotalaria Juncea* having a length to diameter of more than about 125.

Since *Crotalaria juncea* has such a desirable long fiber content, it has been discovered that it can be used as a replacement for soft wood fibers when making paper from various vegetable sources such as bagasse, bamboo and straws. These various vegetable fiber sources have a relatively short fiber with the result that when a paper is to be made using these fibers, an amount of soft wood long fiber has to be added in order to reach the desired levels of strength for the final paper product. A process has been discovered for processing *Crotalaria Juncea* into an acceptable pulp for making various paper products. Paper products made with *Crotalaria Juncea* fibers comprising up to about 25 percent by weight of the fiber content of the product have a tear strength of 50 percent more than when soft wood is used as the long fiber source. And, while getting this increase in tear strength, the tensile strength of the fiber product remains in the same range as that for wood. This is a significant advantage since paper mills in parts of the world where there is no ready source of soft wood for its long fiber must import soft wood pulp from other parts of the world. This is quite expensive. The ability to use *Crotalaria Juncea* as the long fiber source in place of soft wood relieves the need to import fiber. And when it is considered that *Crotalaria Juncea* fixes nitrogen into the soil when it is grown, and further when it is considered that *Crotalaria Juncea* only requires 70 to 90 days to reach maturity, the advantages of using this material as a long fiber source are overwhelming.

SUMMARY OF THE INVENTION

It has been found that *Crotalaria Juncea* can be effectively formed into a pulp by using a particular sequence of preparation prior to being fed to a digester and, further, by the use of particular digestion steps. The use of the present fiber preparation steps reduces the amount of rejects during the pulp screening stage and reduces the pitch content of the paper product. *Crotalaria juncea*, after harvesting, should be reduced in moisture content to below about 30 percent by weight (dry basis) and preferably less than about 20 percent by weight. The drying takes place at the field. The *Crotalaria Juncea* after cutting is allowed to lay in the field for about 72 hours. The *Crotalaria Juncea* fiber is then picked up, chopped to smaller pieces of less than about 10 centimeters and preferably about 2 to 6 centimeters and transported to the pulp mill. The chopped *Crotalaria juncea* is then shredded to separate the fibers and is then fed into a depither which removes leaves, some dirt, and pith from the *Crotalaria juncea*. After this stage of depithing, the fiber is then washed and subsequently fed to a second depither for wet depithing. After wet depithing, the fiber is fed into the first tubular chamber of a multi-tubular chamber digester. An aqueous sodium hydroxide solution is also added along with the fiber. The sodium hydroxide solution is at least about 8 percent by weight sodium hydroxide, and preferably about 9 to 12 percent sodium hydroxide. This tubular digester is heated to above about 180° C. and preferably to about 190° C. to 200° C. for from about 10 to 40 minutes. Preferably the residence time is about 15 to 25 minutes. The partially digested fiber is then fed to a second tubular digester. This second tubular digester is maintained at a temperature of more than about 160° C. and preferably more than about 170° C. The residence time of the fiber in the second tubular digester is from about 10 minutes to 40 minutes and preferably about 15 to 25 minutes. The fiber from the second tubular digester is then optionally flowed to a third tubular digester. The time in a third tubular digester can be the same as the residence time in the first and second tubular digesters. In addition, between tubular digesters, there can be a refiner which will function to open up the fibers prior to the next stage of digestion. Further between digestion stages there is preferably a rapid reduction pressure of at least 1 kg/cm$^2$. After the last stage of digestion, the fiber is optionally refined and sent to blowdown where the pressure on the fiber is reduced to atmospheric pressure. The fiber is then washed, screened, bleached and washed prior to being used as the feed to a paper machine.

In one technique, the *Crotalaria juncea* pulp that is formed is admixed with a pulp formed from a short fiber source in order to make a final paper pulp for feed to a paper machine. Examples of short fiber sources are the various vegetable fibers such as bagasse, hardwoods and straws. Very effective results are achieved by admixing up to about 35 percent by weight (dry basis), and preferably up to about 25 weight percent of *Crotalaria Juncea* fiber pulp to the short fiber source. However, it is also possible to digest the *Crotalaria Juncea* and the short fiber source together.

A prime objective of the present invention is to develop a technique for producing a suitable pulp for making paper using *Crotalaria Juncea* as one of the source fibers. It is also an objective of the present invention to develop processes whereby *Crotalaria Juncea* and various vegetable fiber sources such as bagasse, hardwoods and straws can be combined to form a pulp suitable for making high grades of paper.

DETAILED DESCRIPTION OF THE INVENTION

It has been found that *Crotalaria juncea* can be converted into a useful pulp for making paper products through the use of a particular pre-processing and pulping technique. *Crotalaria juncea*, when it is harvested, has a moisture content of about 70 to 90 percent by weight. In order to be effectively used, the moisture content should be reduced to below about 30 percent by weight, and preferably to about 20 percent by weight prior to any processing. One effective technique that can be used to decrease the moisture content is to allow the *Crotalaria juncea* stalks to remain in the field after they have been cut. If left in the field during a period when there isn't any rain, the stalks will decrease in moisture content to less than about 30 percent by weight within about 48 to 96 hours. Another technique that can be used to reduce the water content of the harvested *Crotalaria juncea* would be to bring the harvested stalks to the mill and use waste heat from the pulping process to heat the stalks and to drive off the excess water content.

After the water content has been reduced to less than about 30 percent by weight, and preferably less than about 20 percent by weight, the stalks are cut into pieces of about 4 to 30 centimeters and preferably about 8 to 16 centimeters. These fragments of *Crotalaria Juncea* are then fed into a moist depither. The moisture content of the fiber in the moist depither is maintained at about 15 to 30 weight percent water. In this depither, leaves, some dirt and pith from the fiber stalk are removed from the *Crotalaria juncea*. Also removed is a minor amount of the wax content of the stalk. The depithed fiber is then washed in order to remove any clinging dirt, pith and soluble foreign material. After being washed, the fiber is flowed into a wet depither. The wet depither further removes pith from the fibers and also serves to further separate the fiber pieces.

Essentially any depithers and washers can be used in the preparation of the *Crotalaria juncea*. However, it is preferred to use a depither as described in U.S. Pat. Nos. 3,537,142; 3,688,345 and 4,641,792. The washer is preferably a fiber washer as described in U.S. Pat. Nos. 3,877,110; 3,992,745 and 4,635,322. The depithers and washer are preferably operated in an assembly such as that set forth in U.S. Pat. Nos. 4,231,136 or 4,237,582. The assembly whereby the fiber which is depithed in the moist depither is flowed directly to the washer, then from the wash directly to the wet depither is a preferred mode of operation. This requires less fiber metering and produces a constant flow of fiber to the equipment. The result is a cleaner fiber and a fiber which has experienced less damage.

In the next step, the fiber is fed to a tubular digester. A typical tubular digester is about 5 to 25 meters in length and about 0.5 to 2 meters in diameter. A rotating screw continuously conveys the fiber through the tubular digester. The wet depithed fiber is flowed into the tubular digester along with a sodium hydroxide solution. The sodium hydroxide solution has a greater than about 8 percent by weight concentration of sodium hydroxide and preferably about a 10 percent by weight concentration of sodium hydroxide. This is a comparatively high sodium hydroxide content, but this has been found to be necessary since the *Crotalaria juncea* plant has a high wax content. The amount of sodium hydroxide on the fiber is from about 10 to 35 percent by weight. The temperature in the first digester is maintained at greater than about 180° C. and preferably at about 190° C. to 200° C. The residence time of the fiber in the first digester is from about 10 minutes to about 40 minutes. Preferably the residence time is about 25 minutes. After the first digester the pressure on the fiber is rapidly reduced and the fiber is flowed to a second digester. The rapid reduction in pressure causes some of the water contained in the fiber bundles to convert to steam and to open these bundles. Between the first digester and the second digester there can optionally be a refiner which will serve to further open the fibers. In addition, some sodium hydroxide solution can be added at this point. If further sodium hydroxide solution is added at this point, it is added while the fiber is at the temperature and pressure of the first digester. As the fiber is flowed into the second digester, the pressure on the fiber is reduced at least about 1 kilogram per square centimeter. This results in a temperature drop of at least about 10° C. The fiber is then flowed through the second tubular digester at this lower temperature and pressure by means of a rotating screw. The temperature in the second tubular digester is maintained at above about 160° C. and preferably above about 170° C. The residence time of the fiber in the second tubular digester is from about 10 minutes to about 40 minutes and preferably about 25 minutes. Upon exit from the second tubular digester, the fiber can be refined and sent to blowdown to atmospheric pressure or it can undergo a third stage of tubular digestion. If the fiber undergoes a third stage of tubular digestion the fiber is flowed to a third tubular digester which is maintained at above about 150° C. and preferably above about 160° C. Between the second and third digester there can be a refiner and, in addition, sodium hydroxide solution can be added to the fiber between these stages. As in the addition of sodium hydroxide between digestion stages 1 and 2, the addition of sodium hydroxide between digestion stages 2 and 3 would take place prior to any pressure reduction on the fiber. The fiber in a third tubular digester will be at a pressure of at least about 1 kilogram per square centimeter less than that of the pressure in the second tubular digester. Likewise, the temperature in the third tubular digester will be at least about 10° C. less than that of the second tubular digester. After the third stage of digestion, if three stages of digestion are used, the fiber is then refined and send to blowdown.

After blowdown, the fiber is washed, screened and bleached with a washing after bleaching to remove bleach chemicals. Any conventional technique that is used to wash, screen and bleach bagasse, bamboo or similar sources of fiber can be used. In fact, a suitable washing, screening and bleaching technique is that as used for bagasse fiber. This consists of the sequence of washing, screening, bleaching and washing to remove the bleach chemicals. The washing after digestion is to remove the remaining sodium hydroxide and any by-products. This is usually a countercurrent wash using fresh or mill water. After washing, the fibers are screened to remove any large fiber bundles. These can be recycled. The screened fiber is then bleached using a bleach such as ozone, hydrogen peroxide, chlorine, chlorine dioxide, sodium hypochlorite, zinc hydrosulfite or zinc hydropersulfite. The preferred bleaching operation is to use a four-stage sequence consisting of a chlorine first stage, a caustic extraction second stage, a hypochlorite third stage and a hypochlorite or chlorine dioxide fourth stage. Essentially any conventional pulp bleach and pulp bleaching sequence can be used. After the bleaching operation is completed, the fiber is again washed in a countercurrent manner and is ready for use. In use, about 2 to 35 percent by weight (dry basis) of this fiber, and preferably about 5 to 20 percent by weight, will be added to bagasse or other short fiber source pulp. However the *Crotalaria juncea* pulp can be used by itself to make paper products.

The *Crotalaria juncea* fiber provides various benefits when combined with bagasse, straws and other short fiber materials on a paper machine. The *Crotalaria juncea* pulp, with its longer fiber, improves the drainage of the fiber on the wet end of the paper machines, thereby allowing higher paper machine speeds and producing improved mechanical properties for the paper. However, besides providing advantages during the making of the paper, the addition of *Crotalaria juncea* pulp into a short fiber pulp results in a final paper product which has increased tear strength, has a tensile strength similar to that when wood is used as the long fiber source, has an increased brightness and an opacity which is similar to that when wood is used as the long fiber source. The net of the matter is that the replacement of soft wood long fiber with *Crotalaria juncea* long fiber has no real disadvantages. There are also certain advantages in that the *Crotalaria juncea* provides for better drainage on the paper machine and produces a paper with a significantly increased tear strength. The tensile strength is similar and the brightness is slightly improved. Consequently, in areas of the world where there is no soft wood source for the long fibers that are needed in paper making, the use of *Crotalaria juncea* will be an effective replacement source for long fibers in pulps.

It is also possible to co-pulp one or more of the other fiber sources with the *Crotalaria juncea.* In one embodiment bagasse and *Crotalaria juncea* will be combined prior to a first depithing stage. In this embodiment the *Crotalaria juncea* and bagasse are fed to the first depithing stage in a mixture. The fibers become well mixed in the depithing-washing-depithing sequence. The mixed fiber is then co-digested as discussed above. This process provides capital cost economics since only a single digestion line is required. However, since the digestion conditions for bagasse and for *Crotalaria juncea* are quite different, the co-digestion does not produce an optimum bagasse pulp or *Crotalaria juncea* pulp. For instance, under the more mild digestion conditions required for bagasse, the percent of *Crotalaria juncea* rejects from the screening stage increases. If the digestion conditions are changed to optimize the pulping of the *Crotalaria juncea* the bagasse fiber will be excessively attacked with the result of decreased per properties. However, it is very possible to co-preparation and to co-pulp other fibers with *Crotalaria juncea.* These will usually be fibers such as bagasse, straw or hardwood derived fibers. In general, the same preparation sequence and digestion sequence will be used with the exception that the caustic concentration of the digestion solution will be reduced to about 8 weight percent. The digestion times will be within the above-stated ranges. In addition, the post-digestion steps of washing, screening and bleaching will remain the same.

In a co-preparation sequence the *Crotalaria juncea* will be present in an amount of about 2 percent by weight to about 35 percent by weight of the total fiber content. Preferably the *Crotalaria juncea* content is about 5 percent by weight to about 20 percent by weight. In this way, the *Crotalaria juncea* can replace all of the wood derived from long fiber sources.

The present process for processing *Crotalaria juncea* will be further described with reference to the following examples.

EXAMPLE 1

This example sets out the forming of a pulp from *Crotalaria juncea* fiber and from a mixture of *Crotalaria juncea* fiber and bagasse. In this example, the *Crotalaria juncea* and bagasse were combined and then digested. However, it is generally preferred to separately pulp the bagasse and *Crotalaria juncea* and then to combine the fibers at a later stage. The fibers can be combined after the steps of digestion, washing, screening or bleaching. Usually the fibers are bleached separately and then combined.

This example shows the effect of fiber preparation prior to digestion on the product. The key factors to be considered are the percentage of rejects and the pitch content. The rejects are the large, partially digested fiber bundles that are removed from the pulp during screening. These rejects are recycled to the digester for further digestion. The pitch content is the content of black spots in the paper. These come from the resin content of the *Crotalaria juncea*. These black spots cannot be bleached out of the paper.

TABLE I

| | 1 | 2 | 3 | 4 |
|---|---|---|---|---|
| Depith | Yes | No | Yes | Yes |
| Wash | Yes | No | No | Yes |
| Wet Depith | Yes | No | No | Yes |
| NaOH % on Fiber | 20 | 20 | 20 | 20 |
| Digestion Stages | 3 | 3 | 2 | 2 |
| Residence Time per Stage | 21 min. | 21 min. | 21 min. | 21 min. |
| Pressures in lbs/sq in. | | | | |
| Stage 1 | 120 | 120 | 120 | 140 |
| Stage 2 | 105 | 105 | 105 | 130 |
| Stage 3 | 90 | 90 | 90 | 110 |
| Rejects % | 25 | 50 | 30 | 1 |
| KMnO4 No. | 32.6 | 38 | 32 | 10/12 |
| Pitch Content | 1.0 | 2.7 | 1.5 | 0.2 |

EXAMPLE 2

A *Crotalaria juncea* fiber pulp was produced in accordance with Run No. 4 of Example 1. This fiber was bleached using a standard CEHH bleaching sequence. A standard bagasse fiber pulp was produced according to a continuous process which consists of two stages of digestion with a rapid depressurization between stages. This fiber was likewise bleached. The wood long fiber pulp that was used was derived from purchased dry wood pulp. This dry wood pulp was converted back to a pulp through the addition of water and the use of a shear type of mixing.

These pulps were combined in various amounts in order to determine whether a *Crotalaria juncea* pulp can be used to replace the wood derived long fibers when producing papers using bagase as the primary fiber source. Table II provides data on the quality of the various papers.

TABLE II

| Product | Book Paper 115 g/m² | | Writing Tablet 60 g/m² | | Book Paper A Blanqueado 70 | |
|---|---|---|---|---|---|---|
| Crotalaria Juncea % | 0 | 8.00 | 0 | 5.60 | 0 | 6.02 |
| Wood Long Fiber % | 18 | 10.50 | 18 | 12.21 | 18 | 15.10 |
| Bagasse % | 82 | 81.50 | 82 | 83.19 | 82 | 78.88 |
| Tear Strength MD* gr. | 54–68 | 88 | 25–35 | 44 | 30 | 56 |
| Tear Strength MD* gr. | 56–72 | 120 | 32–40 | 44 | 32 | 58 |
| Tensile Strength MD* gr. | 16–18 | 18 | 8–12 | 10.8 | 10–12 | 11.6 |
| Tensile Strength CD* gr. | 8–9 | 13 | 5–7 | 6.0 | 6 | 6.6 |
| Brightness °GE | 82–86 | 88 | | | 82 | 88 |
| Opacity % | 90–92 | 90.6 | 75–77 | 75.4 | 80 | 80.6 |

*MD means machine direction
*CD means cross direction

It is seen from Table II that the tear strength is improved with no harmful effect on the tensile strength through the use of *Crotalaria juncea* fibers as a replacement for wood derived long fibers. The brightness is also improved. This is a significant discovery since in many areas of the world wood long fiber must be imported. However, since most of these are tropical areas, *Crotalaria juncea* can be readily cultivated. This results in considerable savings since an expensive imported material can be replaced with a domestically produced material.

What we claim is:

1. A method for producing a paper pulp using *Crotalaria juncea* as the primary source of long fiber comprising:

a. harvesting said *Crotalaria juncea;* b. reducing the moisture content of the *Crotalaria juncea* to less than about 30 percent by weight;

c. reducing the size of the pieces of said *Crotalaria juncea* to smaller fragments;

d. shredding and depithing said *Crotalaria juncea* at its ambient moisture level;

e. washing the depithed *Crotalaria juncea;* f. wet depithing the washed *Crotalaria juncea;* g. contacting the washed and depithed *Crotalaria juncea* fibers with an aqueous solution comprising sodium hydroxide containing at least about 8 percent by weight sodium hydroxide at a temperature of greater than about 180° C. for a first period of time;

h. rapidly reducing the pressure at least about 1 kg/cm² with a resulting reduction of temperature and continuing the contact of said *Crotalaria juncea* fibers with said aqueous sodium hydroxide for a second period of time; and i. recovering a *Crotalaria juncea* paper pulp.

2. A method for producing a paper pulp using *Crotalaria juncea* as the primary source of long fibers as in claim 1 wherein the moisture content of said *Crotalaria juncea* is reduced to about 20 percent by weight prior to being reduced in size.

3. A method for producing a paper pulp using *Crotalaria juncea* as the primary source of long fiber as in claim 1 wherein the concentration of sodium hydroxide on said *Crotalaria juncea* fibers is about 10 percent by weight to about 35 percent by weight.

4. A method for producing a paper pulp using *Crotalaria juncea* as the primary source of long fiber as in claim 1 wherein during the contacting of said *Crotalaria juncea* with sodium hydroxide for a first period of time said temperature is maintained at about 190° C. to 200° C.

5. A method for producing a paper pulp using *Crotalaria juncea* as the primary source of long fiber as in claim 4 wherein during continuing contact of *Crotalaria juncea* with sodium hydroxide for a second period of time said temperature is about 175° C. to 185° C.

6. A method for producing a paper pulp using *Crotalaria juncea* as the primary long fiber source as in claim 1 wherein prior to continuing the contact of said *Crotalaria juncea* with sodium hydroxide for a second period of time said *Crotalaria juncea* is processed in a refiner.

7. A method for producing a paper pulp using *Crotalaria juncea* as the primary long fiber source as in claim 1 wherein after said *Crotalaria juncea* is processed in a refiner said *Crotalaria juncea* is washed, screened and bleached.

8. A method for producing a paper pulp using *Crotalaria juncea* as the primary long fiber source as in claim 1 wherein a pulp consisting primarily of short fibers is admixed with said *Crotalaria juncea* pulp.

9. A method for producing a paper pulp using *Crotalaria juncea* as the primary long fiber source as in claim 8 wherein said *Crotalaria juncea* fibers comprise from about 2 weight percent to about 35 percent by weight of the fiber content of the admixed pulp.

10. A method for producing a paper pulp using *Crotalaria juncea* as the primary source of long fibers as in claim 9 wherein said *Crotalaria juncea* fibers comprise from about 5 percent by weight to about 20 percent by weight of the fiber content of the admixed pulp.

11. A method for producing a paper pulp using *Crotalaria juncea* as the primary source of long fibers as in claim 9 wherein said pulp consisting primarily of short fibers is selected from the group consisting of bagasse pulp, hardwood pulp and straw pulp.

12. A method for producing a paper pulp using *Crotalaria juncea* as the primary source of long fibers as in claim 1 wherein the contact of said *Crotalaria juncea* with said aqueous sodium hydroxide is for periods of time greater than about 15 minutes.

13. A method for producing a paper pulp using *Crotalaria juncea* as the primary source of long fibers as in claim 1 wherein a fiber source that yields short fibers after digestion is admixed with said *Crotalaria juncea* prior to depithing.

14. A method for producing a paper pulp using *Crotalaria juncea* as the primary source of long fibers as in claim 13 wherein said fiber source that yields short fibers is selected from the group consisting of bagasse, straw and hardwoods.

15. A method for producing a paper pulp using *Crotalaria juncea* as the primary source of long fibers as in claim 14 wherein said fiber source is bagasse.

16. A method for producing a paper pulp using *Crotalaria juncea* as the primary source of long fibers as in claim 13 wherein said fiber source that yields short fibers is present in a concentration of about 2 percent by weight to about 30 percent by weight.

17. A method for producing a paper pulp using *Crotalaria juncea* as the primary source of long fibers as in claim 16 wherein the concentration of said fiber source that yields short fibers is about 5 percent by weight to about 30 percent by weight.

18. A paper pulp comprised of from about 2 percent by weight to about 35 percent by weight *Crotalaria juncea* according to claim 1 and from about 65 percent by weight to about 98 percent by weight of a short fiber source.

19. A paper pulp as in claim 18 wherein said short fiber source is selected from the group consisting of bagasse, straw and hardwoods.

20. A method for preparing *Crotalaria juncea* for digestion comprising:

a. harvesting said *Crotalaria juncea;*
b. reducing the moisture content of the *Crotalaria juncea* to less than about 30 percent by weight;
c. reducing the size of the pieces of said *Crotalaria juncea* to smaller fragments;
d. shredding and depithing said *Crotalaria juncea* at its ambient moisture level;
e. washing the depithed *Crotalaria juncea*; and
f. wet depithing the washed *Crotalaria juncea.*

* * * * *